US006312884B1

(12) United States Patent
Link et al.

(10) Patent No.: US 6,312,884 B1
(45) Date of Patent: Nov. 6, 2001

(54) PHOTOGRAPHIC ELEMENT

(75) Inventors: Steven G. Link; John D. Mee, both of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/533,573

(22) Filed: Mar. 23, 2000

Related U.S. Application Data

(63) Continuation-in-part of application No. 09/222,189, filed on Dec. 29, 1998, now abandoned.

(51) Int. Cl.[7] ..... G03C 1/14; G03C 1/16; G03C 1/18

(52) U.S. Cl. ..... 430/583; 430/585

(58) Field of Search ..... 430/583, 585

(56) References Cited

U.S. PATENT DOCUMENTS

| | | |
|---|---|---|
| 2,610,121 | 9/1952 | De Smet et al. . |
| 3,490,910 | 1/1970 | Rauch et al. . |
| 5,302,506 | 4/1994 | Kagawa et al. . |
| 5,332,657 | 7/1994 | Irie et al. . |
| 5,597,687 | 1/1997 | Dobles et al. . |
| 5,723,280 | 3/1998 | Link et al. . |

FOREIGN PATENT DOCUMENTS

| | | |
|---|---|---|
| 3028167 | 4/1982 | (DE) . |

*Primary Examiner*—Thorl Chea
(74) *Attorney, Agent, or Firm*—Edith A. Rice

(57) ABSTRACT

This invention comprises a photographic element comprising a light sensitive silver halide emulsion layer which contains a sensitizing dye of the formula:

wherein:

n is 0 or 1;

X, Y, and Z are independently O, N, S, Se, or C;

X' is O, $NR_{13}$, S, or Se;

$R_1$ and $R_2$ are acid substituted alkyl;

$R_4$ is H or alkyl, with the proviso that if X' is N, $R_4$ is H;

each of $R_6$, $R_7$, $R_8$ and $R_9$ is independently H or a substituent or $R_7$ and $R_8$ or $R_8$ and $R_9$ together with the carbon atoms to which they are attached form a 5-membered or 6-membered ring;

when X or Y or Z is O, N, S or Se then a, b or c, respectively, is 0 and when X or Y or Z is C, a, b or c, respectively is 1 and the corresponding $R_{10}$, $R_{11}$, or $R_{12}$ substituent is independently H or a non-aromatic substituent; and $R_{13}$ is alkyl or substituted alkyl.

26 Claims, No Drawings

PHOTOGRAPHIC ELEMENT

CROSS REFERENCE TO RELATED APPLICATION

This application is a continuation in part of application Ser. No. 09/222,189 abandoned filed Dec. 12, 1998, the entire disclosures of which is incorporated by reference.

FIELD OF THE INVENTION

This invention relates to the field of photographic elements, and in particular to photographic elements with reduced sensitizing dye stain.

BACKGROUND OF THE INVENTION

In photographic systems, sensitizing dyes that are not removed during processing may give rise to undesirable background stain. Additionally, many sensitizing dyes are used in their J-aggregate state. Such aggregation tends to increase the difficulty in removal of the dyes during processing.

SUMMARY OF THE INVENTION

We have discovered a class of dyes which gives rise to unexpectedly low levels of post-process dye stain. This low staining property is maintained, even when dyes of this type are used in their J-aggregate state. For instance, in a color negative application, there is a need for efficient J-aggregating sensitizing dyes for the short red spectral region (590–640 nm) which give rise to minimal post-process dye stain. These requirements can be met by dyes of the present invention.

One aspect of the invention comprises a photographic element comprising a light sensitive silver halide emulsion layer which contains a sensitizing dye of the formula:

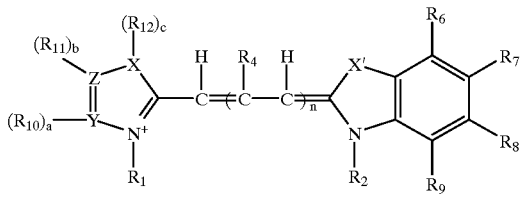

wherein:

n is 0 or 1;

X, Y, and Z are independently O, N, S, Se, or C;

X' is O, $NR_{13}$, S, or Se;

$R_1$ and $R_2$ are acid substituted alkyl;

$R_4$ is H or alkyl, with the proviso that if X' is N $R_{13}$, $R_4$ is H;

each of $R_6$, $R_7$, $R_8$ and $R_9$ is independently H or a substituent or $R_7$ and $R_8$ or $R_8$ and $R_9$ together with the carbon atoms to which they are attached form a 5-membered or 6-membered ring;

when X or Y or Z is O, N, S or Se then a, b or c, respectively, is 0 and when X or Y or Z is C, a, b or c, respectively is 1 and the corresponding $R_{10}$, $R_{11}$, or $R_{12}$ substituent is independently H or a non-aromatic substituent; and $R_{13}$ is alkyl or substituted alkyl.

DETAILED DESCRIPTION OF THE INVENTION

As set forth above this invention provides photographic elements with reduced dye stain. The dyes are of the general formula:

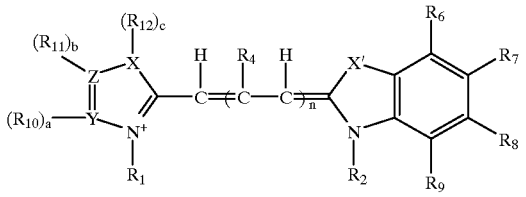

wherein:

n is 0 or 1;

X, Y, and Z are independently O, N, S, Se, or C;

X' is O, $NR_{13}$, S, or Se;

$R_1$ and $R_2$ are acid substituted alkyl; acid salt groups include carboxy, sulfo, phosphato, phosphono, sulfonamido, sulfamoyl, or acylsulfonamido (groups such as —$CH_2$—CO—NH—$SO_2$—$CH_3$) groups. Note that reference to acid or acid salt groups are used to define only the free acid groups or their corresponding salts, and do not include esters where there is no ionizable or ionized proton. Particularly preferred are the carboxy and sulfo groups (for example, 3-sulfobutyl, 4-sulfobutyl, 3-sulfopropyl, 2-sulfoethyl, carboxymethyl, carboxyethyl, carboxypropyl and the like);

$R_4$ is H or alkyl, with the proviso that if X' is N $R_{13}$, $R_4$ is H;

each of $R_6$, $R_7$, $R_8$ and $R_9$ is independently H or a substituent or $R_7$ and $R_8$ or $R_8$ and $R_9$ together with the carbon atoms to which they are attached form a 5-membered or 6-membered ring; "Examples of substituents are a substituted or unsubstituted alkyl group, a substituted or unsubstituted aromatic group, a halogen atom, an acylamino group, a carbamoyl group, a carboxy group, or an alkoxy group;"

when X or Y or Z is O, N, S or Se then a, b or c, respectively, is 0 and when X or Y or Z is C, a, b or c, respectively, is 1 and the corresponding $R_{10}$, $R_{11}$, or $R_{12}$ substituent is independently H or a non-aromatic substituent; and $R_{13}$ is alkyl or substituted alkyl.

Non-aromatic substituents include, for example, alkyl, alkenyl, cycloalkyl, non-aromatic carbocyclic substituents, such as cycloalkyl, non-aromatic heterocyclic substituent, such as cyclic ethers, and the like. Each of these substituents may be further substituted with, for example, halogens, alkoxy groups, alkoxycarbonyl groups, etc.

In preferred embodiments of the invention, Y is N or C, Z is C and X is S.

Particularly preferred are dyes of the formula:
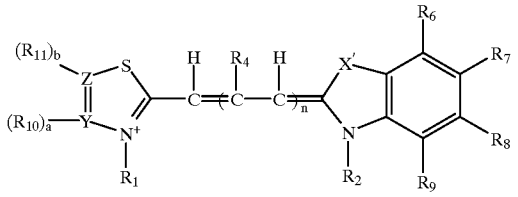
where $R_1$, $R_2$, $R_4$, $R_6$, $R_7$, $R_8$, $R_9$ , $R_{10}$, $R_{11}$, a, b and X' have the same meaning as above and Y is N or C.
Non-limiting examples of preferred dyes are shown below.
I-1
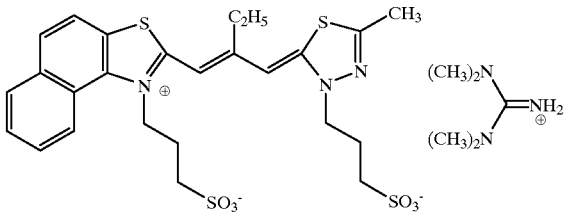
I-2
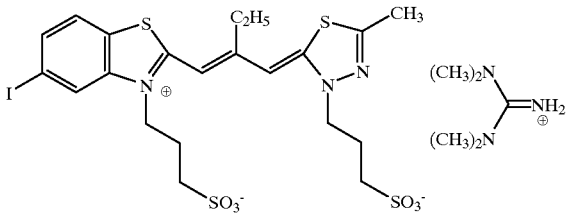
I-3
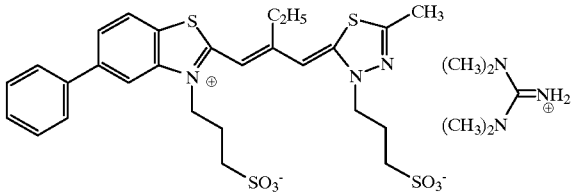
I-4
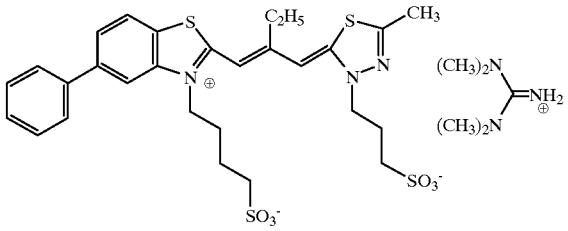
I-5
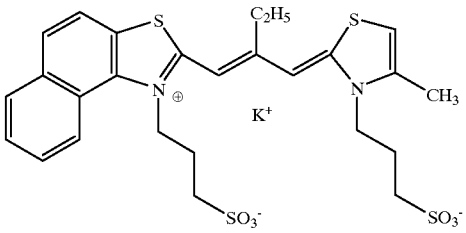
-continued
I-6
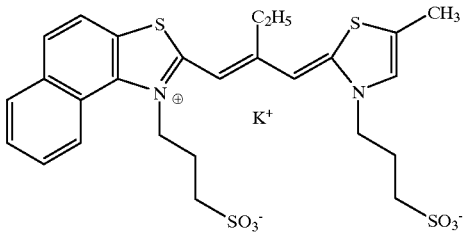
I-7
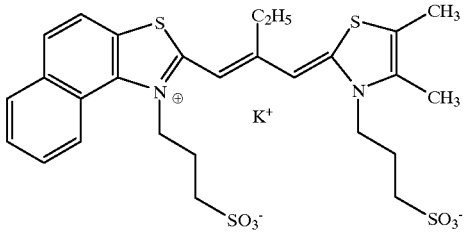
I-8
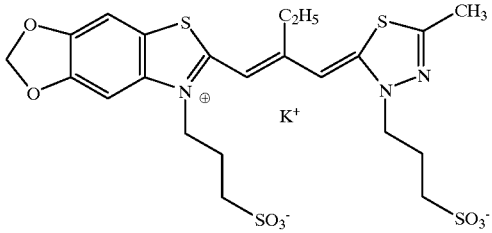
I-11
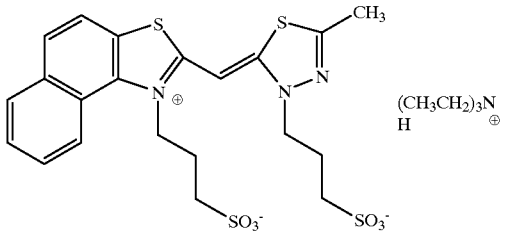
I-12
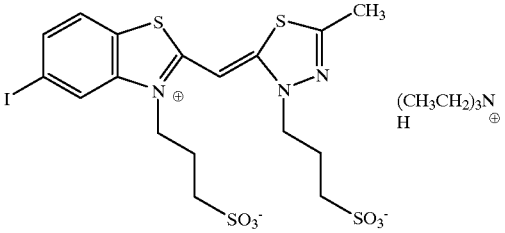
I-13
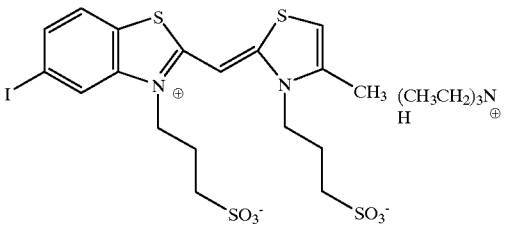

-continued

I-14

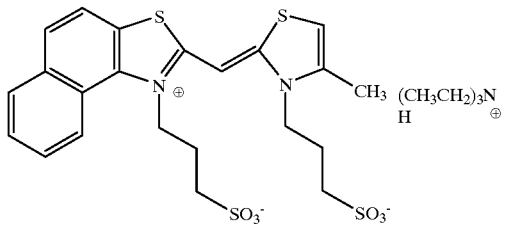

I-15

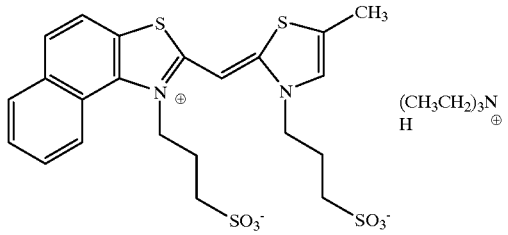

I-16

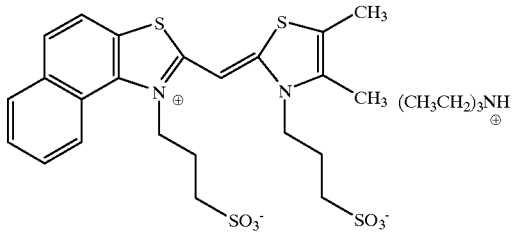

The sensitizing dyes used in the invention can be synthesized by one skilled in the art by known methods, for example procedures described in F. M. Hamer, *Cyanine Dyes and Related Compounds,* 1964 (publisher John Wiley & Sons, New York, N.Y.) and *The Theory of the Photographic Process,* 4$^{th}$ edition, T. H. James, editor, Macmillan Publishing Co., New York, 1977. Synthetic examples are given below.

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. Nos. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure,* September 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); development inhibitors and their precursors (U.S. Pat. Nos. 5,460,932; 5,478,711); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. Nos. 4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed. Tabular grain silver halide emulsions may also be used.

The silver halide grains to be used in the invention may be prepared according to methods known in the art, such as those described in *Research Disclosure I* and *The Theory of the Photographic Process,* $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure,* Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I,* Section IV (pages 510–511) and the references cited therein.

The silver halide may be sensitized by sensitizing dyes by any method known in the art, such as described in *Research Disclosure I.* The dyes may, for example, be added as a solution or dispersion in water, alcohol, aqueous gelatin, alcoholic aqueous gelatin, etc. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I,* section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I,* or in *The Theory of the Photographic Process,* $4^{th}$ edition, T. H. James, editor, Macmillan Publishing Co., New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(?-(methanesulfonamido) ethylaniline sesquisulfate hydrate, 4-amino-3-methyl-N-ethyl-N-(?-hydroxyethyl)aniline sulfate, 4-amino-3-?-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure,* Vol. 116, December, 1973, Item 11660, and Bissonette *Research Disclosure,* Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

The following synthesis examples illustrate the preparation of representative dyes utilized in accordance with the present invention.

Synthesis Example 1

This example illustrates the synthesis of Dye I-2. A suspension of well powdered Anhydro-5-chloro-2-(2-ethoxybutenyl)-3-(3-sulfopropyl)benzothiazolium hydroxide (3.90 g) and Anhydro-2,3-dimethyl-4-(3-sulfopropyl)1,3,3-thiadiazolium hydroxide in acetonitrile (20 mL) was stirred as a solution of 1,1,3,3-tetramethylguanidine (2.30 g) in acetonitrile(5 mL) was added in one portion. After 4 mins, the solution was filtered and the filtrate diluted with ether (200 mL). The ether layer was decanted and the oily residue was extracted with acetone (200 mL) the stirred with acetonitrile (50 mL) until a granular suspension was obtained. The dye was collected and dried. 1.73 g of dye was obtained and further purified by recrystallization from acetonitrile. $\lambda_{max}$(methanol) 526 nm, $\lambda_{max}8.7\times10^4$ Synthesis Example 2

This example illustrates the synthesis of Dye I-15. Anhydro-2,5-dimethyl-3-(3-sulfopropyl)thiazolium hydroxide (2.35 g) and Anhydro-2-hydroxyiminomethyl-1-(3-sulfopropyl)naphtho[1,2-d]thiazolium hydroxide (3.50 g) were stirred in a 9:1 mixture of N,N-dimethylformamide and water (20 mL) as a mixture of acetic anhydride (2.0 g) and triethylamine (4.0 g) was added in a single portion. After 2 min, the dye was precipitated by addition of acetone. The crude dye was purified by recrystallization from a 6:4 mixture of acetonitrile and ethanol. The yield was 1.62 g. $\lambda_{max}$(methanol) 432 nm, $\lambda_{max}6.2\times10^4$ The following examples illustrate the use of sensitizing dyes in photographic elements in accordance with this invention.

EXAMPLE 1

This example illustrates the J-aggregating properties of the dyes.

An iodobromide tabular emulsion (1.29 micron by 0.113 micron, 4.5% iodide) in a gelatin matrix was melted at 40 degrees C. To this emulsion was added a total of 1.05 mmoles of sensitizing dye per mole of silver. Test dyes were added alone or in a combination with a second dye that aggregates at a different wavelength. The dyed emulsion was held at 40 degrees C. for 20 minutes, heated to 65 degrees C. at 1.67 degree/minute, held at 65 degrees C. for 5 minutes, then cooled to 40 degrees C. at 1.67 degrees/minute. The dyed liquid emulsion was then pumped through a flow cell attached to a scanning spectrophotometer. The reflectance spectrum of the emulsion was recorded and transformed to an absorbance spectrum using the Kubelka-Munk transform. Table I shows that the inventive dyes are capable of forming J-aggregates when added alone to the emulsion or when combined with a second dye.

TABLE I

| Sample No. | 1st dye | amount (mmol/mole Ag) | 2nd dye | amount (mmol/mole Ag) | 1st dye solution lambda max | adsorbed lambda max | comment |
|---|---|---|---|---|---|---|---|
| 101 | A | 0.67 | — | — | 537 | 614 | J-agg |
| 102 | — | — | B | 0.33 | 552 | 655 | J-agg |
| 103 | A | 0.67 | B | 0.33 | 537 | 631 | mixed agg |
| 104 | I-1 | 0.67 | — | — | 542 | 621 | J-agg |
| 105 | I-1 | 0.67 | B | 0.33 | 542 | 640 | mixed agg |
| 106 | I-2 | 1.10 | — | — | 526 | 607 | J-agg |
| 107 | I-2 | 0.73 | B | 0.37 | 526 | 638 | mixed agg |
| 108 | I-3 | 0.67 | — | — | 531 | 588 | J-agg |
| 109 | I-3 | 0.67 | B | 0.33 | 531 | 633 | mixed agg |
| 110 | I-4 | 0.67 | — | — | 532 | 588 | J-agg |
| 111 | I-4 | 0.67 | B | 0.33 | 532 | 625/583 | dual agg |
| 112 | I-5 | 0.33 | — | — | 551 | 543 | monomer |
| 113 | I-5 | 0.33 | A | 0.67 | 551 | 614 | dye A agg |
| 114 | I-6 | 0.33 | — | — | 550 | 637 | J agg |
| 115 | I-6 | 0.33 | A | 0.67 | 550 | 616 | mixed agg |
| 116 | I-7 | 0.33 | — | — | 554 | 640 | J agg |
| 116 | I-7 | 0.33 | A | 0.67 | 554 | 616 | mixed agg |
| 117 | I-8 | 0.67 | — | — | 544 | 543 | monomer |
| 118 | I-8 | 0.67 | B | 0.33 | 544 | 654 | dye B agg |
| 119 | I-9 | 0.67 | — | — | 536 | 595 | J agg |
| 120 | I-9 | 0.67 | B | 0.33 | 536 | 647 | mixed agg |
| 121 | I-10 | 0.67 | — | — | 526 | 525 | monomer |
| 122 | I-10 | 0.67 | B | 0.33 | 526 | 655/525 | dye B agg |
| 123 | I-11 | 1.00 | — | — | 423 | 459 | J agg |

TABLE I-continued

| Sample No. | 1st dye | amount (mmol/mole Ag) | 2nd dye | amount (mmol/mole Ag) | 1st dye solution lambda max | adsorbed lambda max | comment |
|---|---|---|---|---|---|---|---|
| 124 | I-12 | 1.00 | — | — | 423 | 434/455 | monomer/ J agg |
| 125 | I-13 | 1.00 | — | — | 418 | 470 | J-agg |
| 126 | I-14 | 1.00 | — | — | 431 | 443 | monomer |
| 127 | I-15 | 1.00 | — | — | 432 | 445 | monomer |
| 128 | I-16 | 1.00 | — | — | 436 | 445 | monomer |

EXAMPLE 2

This example illustrates the lower dye stain achieved by the use of accordance with this invention.

The same emulsion as in Example 1 was dyed in the same way with a total of 0.928 mmoles dye/mole Ag. The dyed emulsion was then diluted with gelatin and water and coated on a cellulose triacetate support with the cyan coupler C-1. Coated amounts were: 2.15 g silver/square meter, 3.91 g gelatin/square meter, and 1.08 g coupler/square meter. The coupler was incorporated as a dispersion that was prepared as 6 wt % coupler, 8 wt % gel, 6 wt % dibutyl phthalate, and 12 wt % ethyl acetate. The unexposed coatings were then processed as follows:

| | |
|---|---|
| 1. pH10 phosphate buffer | 3.25 min |
| 2. bleach | 4 min |
| 3. wash | 3 min |
| 4. fixer | 4 min |
| 5. wash | 3 min |
| 6. stabilizer | 1 min |

The composition of the bleach and fixer solutions are given below:

| Bleach | |
|---|---|
| Ammonium bromide | 25 g/L |
| 1,3-Propanediaminetetraacetic acid | 37.40 g/L |
| Ammonium hydroxide (28%) | 70.00 mL/L |
| Ferric nitrate nonahydrate | 44.85 g/L |
| Glacial acetic acid | 80.00 mL/L |
| 1,3-diamino-2-propanoltetraacetic acid | 0.80 g/L |
| Water to make | 1.00 L |

| Fixer | |
|---|---|
| Ammonium thiosulfate solution 56.5% ammonium thiosulfate 4% ammonium sulfite | 162.00 mL/L |
| Sodium metabisulfite | 11.85 g/L |
| Sodium hydroxide (50%) | 2.00 mL/L |
| Water to make | 1.00 L |

After processing, a piece of the strip was inserted into a scanning spectrophotometer and the spectrum was recorded in transmission mode from 360 to 700 nm. Since no development occurred in the strip, and no image dye was formed, any color left in the strip is due to retained sensitizing dye. The optical density of the spectrum is a measure of the amount of retained dye. The results are shown in Table II.

TABLE II

| Sample No. | 1st dye | amount (mmol/mole Ag) | 2nd dye | amount (mmol/mole Ag) | lambda max | optical density |
|---|---|---|---|---|---|---|
| RED DYES | | | | | | |
| 201 | A | 0.928 | — | — | 559 | 0.196 |
| 202 | B | 0.928 | — | — | 577 | 0.205 |
| 203 | A | 0.619 | B | 0.309 | 561 | 0.181 |
| 204 | C | 0.928 | — | — | 581 | 0.216 |
| 205 | G | 0.928 | — | — | 588 | 0.131 |
| 206 | H | 0.928 | — | — | 570 | 0.154 |
| 207 | I-1 | 0.928 | — | — | 561 | 0.028 |
| 208 | I-1 | 0.619 | B | 0.309 | 575 | 0.087 |
| 209 | I-3 | 0.928 | — | — | 550 | 0.067 |
| 210 | I-3 | 0.619 | B | 0.309 | 557 | 0.106 |
| 211 | I-4 | 0.928 | — | — | 547 | 0.071 |
| 212 | I-4 | 0.619 | B | 0.309 | 556 | 0.092 |
| 213 | I-5 | 0.928 | — | — | — | 0.00 |
| 214 | I-5 | 0.619 | B | 0.309 | 575 | 0.067 |
| 215 | I-6 | 0.928 | — | — | 562 | 0.016 |
| 216 | I-6 | 0.619 | B | 0.309 | 577 | 0.083 |
| 217 | I-7 | 0.928 | — | — | 573 | 0.018 |
| 218 | I-7 | 0.619 | B | 0.309 | 576 | 0.092 |
| 219 | I-8 | 0.928 | — | — | — | 0.00 |
| BLUE DYES | | | | | | |
| 221 | D | 0.928 | — | — | 454 | 0.103 |
| 222 | E | 0.928 | — | — | 442 | 0.079 |
| 223 | F | 0.928 | — | — | 440 | O.098 |
| 224 | I-11 | 0.928 | — | — | — | 0.00 |
| 225 | I-12 | 0.928 | — | — | — | 0.00 |
| 226 | I-13 | 0.928 | — | — | — | 0.00 |
| 227 | I-14 | 0.928 | — | — | — | 0.00 |
| 228 | I-15 | 0.928 | — | — | — | 0.00 |
| 229 | I-16 | 0.928 | — | — | 444 | 0.024 |

These data indicate that the red and blue sensitizing dyes of the invention (samples 207–220 and 224–229) have much less tendency to be retained in the film after processing than the comparison dyes (samples 201–206 and 221–223).

EXAMPLE 3

This example illustrates the spectral sensitization of a cubic emulsion accordance with this invention.

Black-and-white photographic materials were prepared by coating a polyester support with a silver halide emulsion layer containing chemically sensitized 0.2 micron cubic silver iodobromide (2.6 mole % I) at 1.08 g Ag/m$^2$, hardened gelatin at 7.3 g/m$^2$, and sensitizing dye as identified in Table III at 0.8 mmole/mole Ag. The dyes were added to the sensitized emulsion from methanol solution at 40 degrees C. and held for 15 minutes. The coated elements were given a wedge spectral exposure and processed in RP X-OMAT (a trademark) chemistry (a developer containing hydroquinone and p-methylaminophenol as developing agents).

The photographic speed of the dyes is reported in terms of a sensitizing ratio (SR), which is defined as the speed at λ-max (in log E units multiplied by 100) minus the intrinsic speed of the dyed emulsion at 400 nm (in log E units multiplied by 100) plus 200. This measurement of speed allows for comparison while using a uniform chemical sensitization that is not optimized for each dye.

TABLE III

| Sample | Dye | SR Speed |
|---|---|---|
| Red Dyes | | |
| 301 | A | 223 |
| 302 | B | 216 |
| 303 | C | 201 |
| 304 | I-1 | 233 |
| 305 | I-2 | 214 |
| 306 | I-4 | 259 |
| 307 | I-5 | 214 |
| 308 | I-6 | 216 |
| 309 | I-7 | 225 |
| 311 | I-10 | 168 |
| Blue Dyes | | |
| 312 | D | 232 |
| 313 | I-11 | 191 |
| 314 | I-14 | 203 |
| 315 | I-15 | 200 |
| 316 | I-16 | 205 |

These data show that the dyes of the invention are efficient spectral sensitizers as well as being low in stain.

EXAMPLE 4

This example illustrates spectral sensitization of an octahedral emulsion in accordance with this invention.

Black-and-white elements were prepared just as in example 3, except that a 0.3 micron octahedral iodobromide emulsion was used and the dye level was reduced to 0.4 mmole/mole Ag. Coated elements were exposed and processed as in example 3. The data are shown in Table IV.

TABLE IV

| Sample | Dye | SR Speed |
|---|---|---|
| Red Dyes | | |
| 401 | A | 236 |
| 402 | B | 220 |
| 403 | C | 195 |
| 404 | I-1 | 224 |
| 405 | I-2 | 167 |
| 406 | I-3 | 198 |
| 407 | I-4 | 239 |
| Blue Dyes | | |
| 408 | D | 220 |
| 409 | E | 197 |
| 410 | F | 210 |
| 411 | I-11 | 197 |
| 412 | I-14 | 198 |

These data show that the dyes of the invention are efficient spectral sensitizers as well as being low in stain.

EXAMPLE 5

This example illustrates spectral sensitization of a tabular Emulsion in accordance with this invention.

Preparation of sample 501. A Ag $Br_{0.96}I_{0.04}$ tabular emulsion (1.39 μecd (disc centrifuge) by 0.12μthick) that had 1.5% iodide throughout the bulk of the crystal and 2.5% iodide concentrated in a narrow band in the outer 10% of the crystal was prepared by methods described in U.S. Pat. No. 5,254,453, the disclosure of which is incorporated herein by reference. It was chemically and spectrally sensitized as follows (all amounts are per mole of silver):

The emulsion, which contained 40 g of gelatin/Ag mole was melted at 40° C.

100 mg of NaSCN was added.

After 15 min., 35 mg 3-methylsulfonylcarbamoylethylbenzothiazolium fluoroborate was added.

After another 2 min 0.667 mmole of dye A and 0.333 mmole of Dye B were added as a common solution in methanol (2 g/L).

After another 20 min, 2.3 mg aurous dithiosulfate and 1 mg sodium thiosulfate pentahydrate were added.

The emulsion was heated to 1.67 degrees/min to 64° C. for 5 min, then cooled at 1.67 degrees/min to 40° C.

The sensitized emulsion was coated on a cellulose triacetate support that was backed with removable carbon black. The coated amounts of components are given in units of g/m2.

First layer: Emulsion (0.81 g of silver/$m^2$), gelatin 5.38 g), cyan coupler C-1 (0.97 g), cyan coupler C-2 (0.043 g), cyan coupler C-3 (0.043 g), 1,3,3a,7-tetraazaindene (1.75 g/Ag mole), surfactants as coating aids.

Overcoat: Gelatin (1.08 g), surfactants as coating aids. Bis-vinylsulfonylmethyl ether (1.75% by weight of the total gelatin).

Samples 502 through 505 were prepared similarly with the dyes shown in Table V.

Cyan coupler C-1 is given below:

C-1

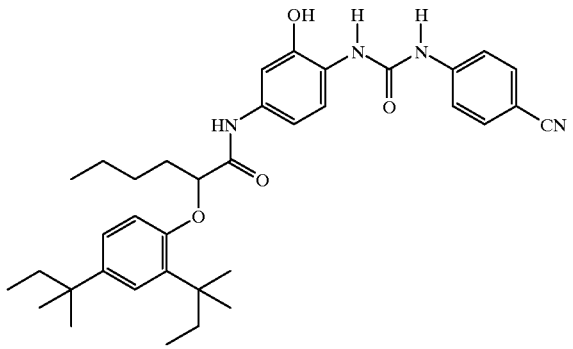

It was added to the coating formula as a dispersion consisting of 60 g C-1, 60 g dibutyl phthalate, 120 g ethyl acetate, and 760 g gelatin, per kg and adjusted to pH 5.1 with 2N propionic acid.

The couplers C-2 and C-3 are shown below. Each was added as a dispersion. The dispersion formulas are also given.

C-2

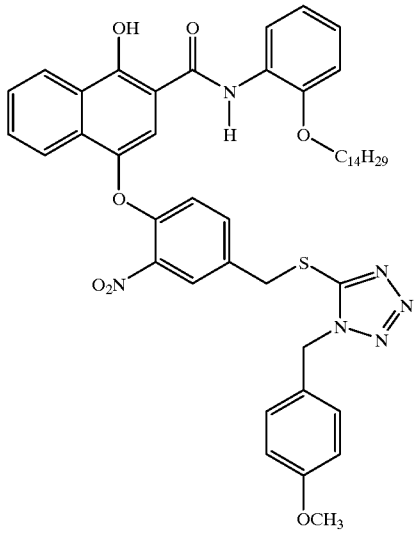

Dispersed as follows: 40 g of C-2, N-butylacetanilide (80 g), gelatin (100 g), water (738 g), 10% sodium triisopropylnaphthalenesulfonate (42 g), adjusted to ph5.1 with 2 N propionic acid.

C-3

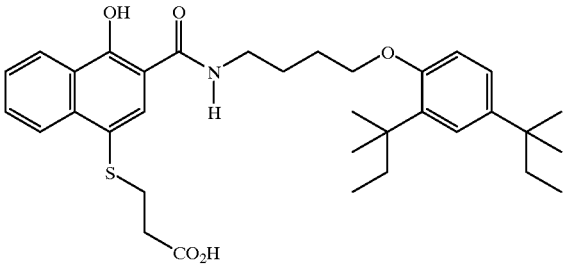

Dispersed as follows: 30 g of C-3, diethyllauramide (30 g), ethyl acetate (90 g), gelatin (80 g), water (770 g), washed to pH 4.65 with 2 N propionic acid.

Strips from the coated samples were exposed with a daylight balanced lamp through a step wedge tablet and a WRATTEN 23A filter, then processed using Kodak Flexicolor C41 process as described in *Brit. J. Photog. Annual,* 1988, p196–198 with the exception that the composition of the bleach solution was changed to comprise propylenediaminetetraacetic acid.

Speeds were measured at a density of 0.15 above the minimum density and are cited as the relative −log E×100. The retained dye stain in the coatings was also measured using the same method as in Example 2.

TABLE V

| Sample | Dye(s) | Amount (mmole/mole) Ag) | Speed | Stain Density |
|---|---|---|---|---|
| 501 | A | 0.67 | 288 | 0.068 |
| | B | 0.33 | | |
| 502 | I-1 | 1.10 | 275 | 0.009 |
| 503 | I-1 | 0.73 | 286 | 0.029 |

TABLE V-continued

| Sample | Dye(s) | Amount (mmole/mole) Ag) | Speed | Stain Density |
|---|---|---|---|---|
| | B | 0.37 | | |
| 504 | I-2 | 1.10 | 243 | 0.000 |
| 505 | I-2 | 0.73 | 266 | 0.027 |
| | B | 0.37 | | |

These data show that the dyes are useful spectral sensitizers for a tabular emulsion in a color format, but offer a dramatic reduction in the level of retained dye after processing.

Comparison Dye Structures

Dye A

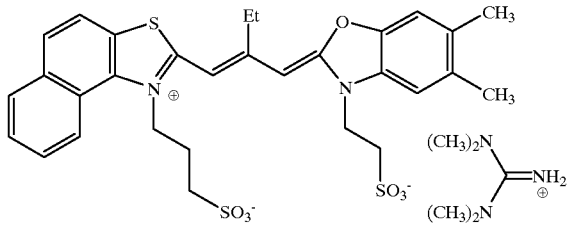

Dye B

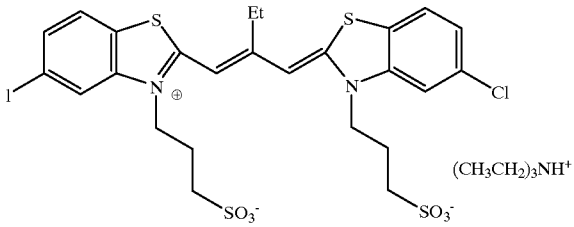

Dye C

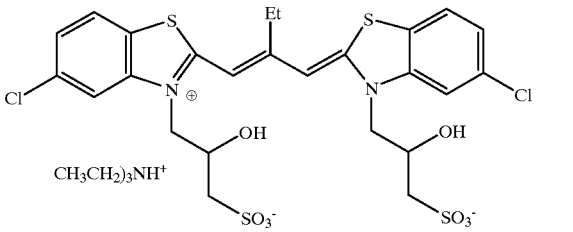

Dye D

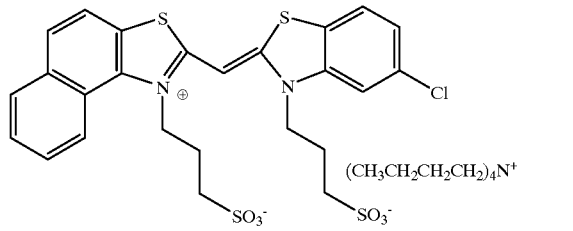

-continued

Dye E

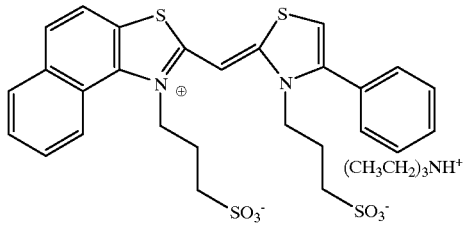

Dye F

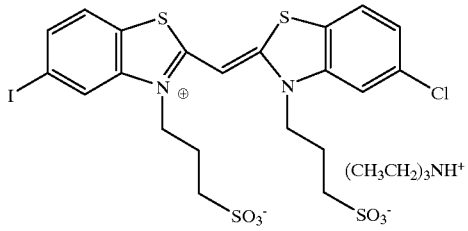

Dye G

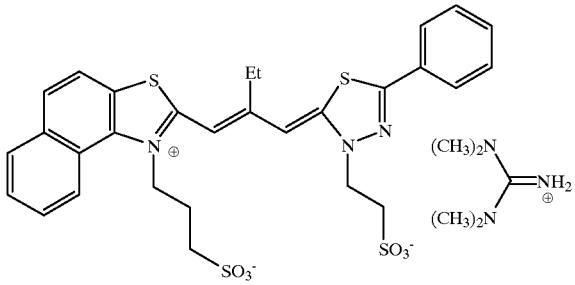

Dye H

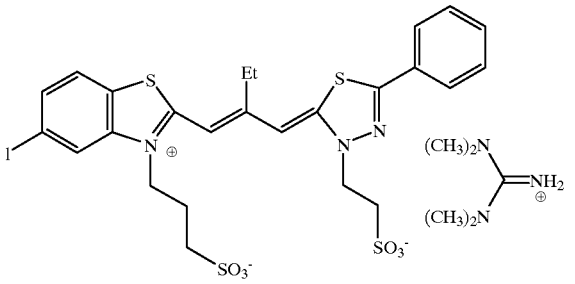

EXAMPLE 6

This example illustrates a color negative multilayer film.

Example 601. A multilayer color negative film (sample 1—1) was prepared by coating on a triacetyl cellulose film support the following layers in order from the support side (amounts given are in grams per $m^2$ with emulsions expressed as grams of silver per $m^2$).

| Layer 1: Antihalation Layer | |
|---|---|
| Black colloidal silver | 0.135 |
| Gelatin | 2.045 |
| Cyan dye 1 | .025 |
| Magenta dye 1 | .018 |
| Yellow dye 2 | .034 |
| UV dye 1 | .075 |

-continued

| | |
|---|---|
| UV dye 2 | .030 |
| Antioxidant 1 | .161 |
| Antifoggant 1 | .001 |
| Antifoggant 3 | .001 |
| Sequestrant 1 | .009 |
| Sequestrant 2 | .229 |
| Layer 2: Slow Cyan Layer | |
| tabular emulsion1 (0.66 micron by 0.12 micron, 4.1% iodide, dyed with 0.641 mMole Dye A and 0.321 mMole Dye B) | .301 |
| tabular emulsion2 (0.55 micron by 0.083 micron, 1.5% iodide, dyed with 0.667 mMole Dye A and 0.333 mMole Dye B) | .492 |
| Gelatin | 1.679 |
| Cyan coupler 1 | .527 |
| Cyan coupler 2 | .027 |
| Cyan coupler 4 | .032 |
| Cyan coupler 5 | .057 |
| Antifoggant 2 | .013 |
| Layer 3: Mid Cyan Layer | |
| tabular emulsion3 (1.07 micron by 0.114 micron, 4.1% iodide, dyed with 0.616 mMole Dye A and 0.308 mMole dye B) | .237 |
| tabular emulsion 4 (1.22 micron by 0.111 micron dyed with dyed with 0.600 mMole Dye A and 0.300 mMole Dye B) | .194 |
| Gelatin | 1.076 |
| Cyan coupler 1 | .170 |
| Cyan coupler 3 | .019 |
| Cyan coupler 4 | .032 |
| Cyan coupler 5 | .008 |
| Antifoggant 2 | .007 |
| Layer 4: Fast Cyan Layer | |
| tabular emulsion 5 (1.33 micron by 0.125 micron, 4.1% iodide, dyed with 0.554 mMole Dye A and 0.277 mMole Dye B) | .592 |
| Gelatin | .914 |
| Cyan coupler 1 | .183 |
| Cyan coupler 3 | .027 |
| Cyan coupler 4 | .022 |
| Antifoggant 2 | .015 |
| Layer 5: Interlayer | |
| Gelatin | .538 |
| Antioxidant 1 | .086 |
| Antifoggant 4 | .064 |
| Layer 6: Slow Magenta Layer | |
| tabular emulsion 6 (0.81 micron by 0.12 micron, 2.6% iodide, dyed with a 4:1 ratio of sensitizing dyes 1 and 2) | .269 |
| tabular emulsion 7 (0.55 micron by 0.083 micron, 1.5% iodide, dyed as above) | .571 |
| Gelatin | 1.076 |
| Magenta coupler 1 | .269 |
| Magenta coupler 2 | .086 |
| Yellow Coupler 1 | .011 |
| Sodium Polystyrenesulfonate | .019 |
| Antifoggant 1 | .0004 |
| Antifoggant 2 | .006 |
| Antifoggant 4 | .001 |
| Layer 7: Mid Magenta Layer | |
| tabular emulsion 8 (1.22 micron by 0.111 micron, 4.1% iodide, dyed with a 4:1 ratio of sensitizing dyes 1 and 2) | .248 |
| tabular emulsion 9 (1.07 micron by 0.114 micron, 4.1% iodide, dyed as above | .248 |
| Gelatin | 1.216 |
| Magenta coupler 1 | .124 |
| Magenta coupler 2 | .118 |
| Yellow Coupler 1 | .043 |
| Antifoggant 2 | .005 |
| Antioxidant 2 ] | .016 |

-continued

| | |
|---|---|
| Layer 8: Fast Magenta Layer | |
| tabular emulsion 10 | .484 |
| (1.33 micron by 0.125 micron, 4.1% iodide, dyed with a 4:1 ratio of sensitizing dyes 1 and 2) | |
| Gelatin | 1.014 |
| Magenta coupler 1 | .075 |
| Magenta coupler 2 | .054 |
| Universal coupler 1 | .030 |
| Cyan coupler 5 | .003 |
| Latex polymer | .008 |
| Antioxidant 2 | .009 |
| Antifoggant 2 | .004 |
| Layer 9: Yellow Filter Layer | |
| Gelatin | .646 |
| Yellow dye 3 | .054 |
| Antifoggant 1 | .086 |
| Antifoggant 4 | .0005 |
| Layer 10: Slow Yellow Layer | |
| emulsion 11 | .398 |
| (1.25 micron by 0.137 micron, 4.1% iodide, dyed with a 1:1 ratio of sensitizing dyes 3 and 4) | |
| tabular emulsion 12 | .269 |
| (0:55 micron by 0.083 micron, 1.5% iodide, dyed as above) | |
| tabular emulsion 13 | .248 |
| (0.77 micron by 0.14 micron, 1.5% iodide, dyed as above) | |
| Gelatin | 1.873 |
| Yellow coupler 2 | 1.076 |
| Yellow coupler 3 | .075 |
| Cyan coupler 1 | .032 |
| Cyan coupler 2 | .032 |
| Cyan coupler 5 | .022 |
| Antifoggant 2 | .015 |
| Antioxidant 3 (manganese) | .005 |
| $AW_{NA}$ polymer | .054 |
| Layer 11: Fast Yellow Layer | |
| tabular emulsion 14 | .377 |
| (2.67 micron by 0.128 micron, 4.1% iodide, dyes as above) | |
| tabular emulsion 11 | .108 |
| (1.25 micron by 0.137 micron, 4.1% iodide, dyed as above) | |
| Gelatin | .807 |
| Yellow coupler 2 | .237 |
| Yellow coupler 3 | .075 |
| Cyan coupler 5 | .005 |
| Latex polymer | .013 |
| Layer 12: Protective Overcoat | |
| Silver bromide Lippman emulsion | .215 |
| Gelatin | 1.237 |
| UV dye 1 | .108 |
| UV dye 2 | .108 |
| Soluble matte | .054 |
| Insoluble matte | .005 |
| Antioxidant 3 [manganese] | .001 |

In addition coating aids and stabilizers were added as is common in the trade. The coating was hardened with 1.75 wt % of bisvinylsulfonylmethane based on the weight of gelatin.

Some components of the coating in example 601 were incorporated as dispersions. The composition of the these dispersions is given in Table VI.

TABLE VI

| Component | wt % | % gel | sol-vent 1 | wt % | solvent 2 | wt % | pH | surfact-ant % |
|---|---|---|---|---|---|---|---|---|
| cyan coupler 1 | 6 | 8 | sol-2 | 6 | sol-10 | 12 | 5.10 | |
| cyan coupler 2 | 3 | 10 | sol-3 | 3 | sol-11 | 9 | 4.70 | |
| cyan coupler 3 | 2 | 10 | sol-2 | 8 | | | 5.10 | 0.7 |
| cyan coupler 4 | 13 | | sol-4 | 2 | | | 5.20 | |
| cyan coupler 5 | 2.7 | 8.1 | sol-3 | 3.5 | sol-11 | 0.5 | 5.05 | 0.25 |
| magenta coupler 1 | 5 | 8 | sol-1 | 4.5 | sol-10 | 15 | 5.00 | |
| magenta coupler 2 | 4 | 8 | sol-1 | 8 | sol-10 | 8 | 5.10 | |
| yellow coupler 1 | 5.9 | 9.6 | sol-2 | 5.9 | sol-11 | 0.5 | 5.10 | 0.4 |
| yellow coupler 2 | 9 | 8 | sol-1 | 4.5 | | | 5.15 | 0.6 |
| yellow coupler 3 | 6 | 8 | sol-1 | 3 | | | 5.10 | 0.6 |
| cyan dye 1 | 2.5 | 6 | sol-2 | 12.5 | | | 5.00 | |
| magenta dye 1 | 4 | 10 | sol-1 | 16 | | | 5.10 | 0.6 |
| yellow dye 1 | 25 | 20 | | | | | 5.20 | |
| yellow dye 2 | 8.7 | 6 | | | sol-11 | 26 | 5.65 | 0.3 |
| uv dye 1 | 3.75 | 10 | sol-1 | 5.25 | | | 5.00 | 0.6 |
| uv dye 2 | 3.75 | | | | | | | |
| uv dye 1 | 7.5 | 9.2 | sol-5 | 2.5 | | | | 0.9 |

sol-1 = tricresyl phosphate,
sol-2 = dibutyl phthalate,
sol-3 = diethyllauramide,
sol-4 = 2-phenoxyethanol,
sol-5 = 1,4-cyclohexanedimethanol,bis-2-ethylhexanoate,
sol-10 = ethyyl acetate,
sol-11 = 2-(2-butoxyethoxy)ethyl acetate,
surfactant = triisopropylnaphthalenesulfonic acid, sodium salt.
In these formulas, solvent 2 is an auxiliary solvent and is generally removed by washing or evaporation after the dispersion is formed.

Example 602 was prepared exactly as example 601 except that the emulsions in layers 2 through 4 were changed as shown below:

Layer 2, Tabular emulsion 2 dyed with 0.79 mmoles dye I-1 per mole silver and 0.26 mmole dye B per mole Ag. The emulsion was coated at a level of 0.818 g $Ag/m^2$ Layer 3, Tabular emulsion 5 dyed with 0.75 mmole dye I-1 per mole of silver and 0.24 mmole dye B per mole Ag. The emulsion was coated at a level of 0.438 g Ag/m2.

Layer 4, Tabular emulsion 5 dyed with 0.75 mmole dye I-1 per mole of silver and 0.24 mmole dye B per mole Ag. The emulsion was coated at a level of 0.602 g Ag/m2.

Description of the components:

Cyan coupler 1. Hexanamide, 2-(2,4-bis(1,1-dimethylpropyl)phenoxy)-N-(4-((((4-cyanophenyl)amino)carbonyl)amino)-3-hydroxyphenyl)-.

Cyan coupler 2. Propanoic acid, 3-((3-(((4-(2,4-bis(1,1-dimethylpropyl)phenoxy)butyl)amino)carbonyl)-4-hydroxy-1-naphthalenyl)thio)-.

Cyan coupler 3. 2-Naphthalenecarboxamide, 1-hydroxy-4-(4-(((1-((4-methoxyphenyl)methyl)-1H-tetrazol-5-yl)thio)methyl)-2-nitrophenoxy)-N-(2-(tetradecyloxy)phenyl)-.

Cyan coupler 4. 2,7-Naphthalenedisulfonic acid, 5-(acetylamino)-3-((4-((3-(((4-(2,4-bis(1,1-dimethylpropyl)phenoxy)butyl)amino)carbonyl)-4-hydroxy-1-naphthalenyl)oxy)phenyl)azo)-4-hydroxy-, disodium salt.

Cyan coupler 5 Propanoic acid, 3-((3-(((2-(dodecyloxy)-5-methylphenyl)amino)carbonyl)-4-hydroxy-1-naphthalenyl)thio)-

Magenta coupler 1. Tetradecanamide, N-(3-((4-((2-((2-(2,4-bis(1,1-dimethylpropyl)phenoxy)-1-xoxbutyl)amino)phenyl)thio)-4,5-dihydro-5-oxo-1-(2,4,6-trichlorophenyl)-1H-pyrazol-3-yl)amino)-4-chlorophenyl)-.

Magenta coupler 2. Tetradecanamide, N-(4-chloro-3-((4-((3,4-dimethoxyphenyl)azo)-4,5-dihydro-5-oxo-1-(2,4,6-trichlorophenyl)-1H-pyrazol-3-yl)amino)phenyl)-2-(3-(1,1-dimethylethyl)-4-hydroxyphenoxy)-.

Yellow coupler 1.

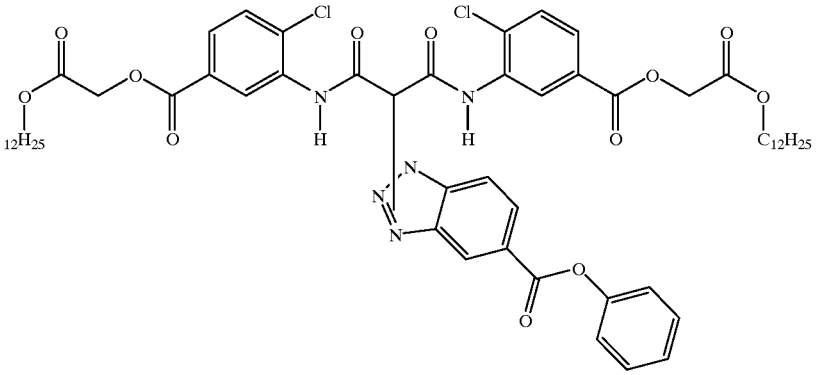

Yellow coupler 2. Benzoic acid, 4-chloro-3-((2-(5,5-dimethyl-2,4-dioxo-3-oxazolidinyl)-4,4-dimethyl-1,3-dioxopentyl)amino)-, hexadecyl ester.

Yellow coupler 3.

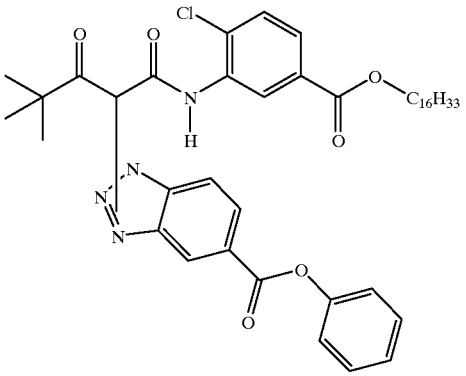

Universal Coupler 1. 1H-Tetrazole-1-acetic acid, 5-(((4-((3-(aminocarbonyl)-4-hydroxy-1-naphthalenyl)oxy)-3-((hexadecylsulfonyl)amino)phenyl)methyl)thio)-, propyl ester.

Cyan dye 1. 2-Naphthalenecarboxamide, N-(4-(2,4-bis(1,1-dimethylpropyl)phenoxy)butyl)-4-((4-(ethyl-(2-hydroxyethyl)amino)-2-methylphenyl)imino)-1,4-dihydro-1-oxo.

Magenta dye 1. Benzamide, 3-(((2,4-bis(1,1-dimethylpropyl)phenoxy)acetyl)amino)-N-(4-((4-((ethyl(2-hydroxyethyl)amino)-2-methylphenyl)imino)-4,5-dihydro-5-oxo-1-(2,4,6-trichlorophenyl)-1H-pyrazol-3-yl)-.

Yellow dye 1. 1-Butanesulfonamide, N-(4-(4-cyano-2-(furanylmethylene)-2,5-dihydro-5-oxo-3-furanyl)phenyl)-.

Yellow dye 2. Benzamide, 3-(((2,4-bis(1,1-dimethylpropyl)phenoxy)acetyl)amino)-N-(4,5-dihydro-4-((methoxyphenyl)azo)-5-oxo-1-(2,4,6-trichlorophenyl)-1H-pyrazol-3-yl)-.

UV dye 1. Propanedinitrile, (3-(dihexylamino)-2-propenylidene

UV dye 2. 2-Propenoic acid, 2-cyano-3-(4-methoxyphenyl)-, propyl ester.

Antifoggant 1. Acetamide, N,N'-(dithiodi-4,1-phenylene) bis.

Antifoggant 2. (1,2,4)Triazolo[1,5-a]pyrimidin-7-ol, 5-methyl-, sodium salt.

Antifoggant 3. 4-Thiazoleacetic acid, 2,3-dihydro-2-thioxo-.

Antifoggant 4. Diammonium Tetrachloropalladate.

Antioxidant 1. 1,4-Benzenediol, 2,5-bis(1,1,3,3-tetramethylbutyl)-.

Antioxidant 2. Benzenesulfonic acid, 2,5-dihydroxy-4-(1-methylheptadecyl)-, monopotassium salt.

Sequestrant 1. Metaphosphoric acid, hexasodium salt.

Sequestrant 2. 3,5-Disulfocatechol, disodium salt.

Sensitizing dye 1 Benzoxazolium, 5-chloro-2-(2-((5-phenyl-3-(3-sulfopropyl)-2(3H)-benzoxazolylidene)methyl)-1-butenyl)-3-(3-sulfopropyl)-, inner salt, triethylamine salt.

Sensitizing dye 2 Benzoxazolium, 3-ethyl-2-(2-((3-(2-((methylsulfonyl)amino)-2-oxoethyl)-2(3H)-benzothiazolylidene)methyl)-1-butenyl)-5-phenyl-, inner salt Sensitizing dye 3 Benzothiazolium, 5-chloro-2-((5-chloro-3-(3-sulfopropyl)-2(3H)-benzothiazolylidene)methyl)-3-(3-sulfopropyl)-, inner salt, triethylamine salt.

Sensitizing dye 4 Benzoxazolium, 2-((5-chloro-3-(s-sulfopropyl)-2(3H)-benzothiazolylidene)methyl)-5-phenyl-3-(3-sulfopropyl)-, triethylamine salt.

Film strips corresponding to examples 601 and 602 were given a 0.01" daylight balanced exposure through a stepped wedge tablet then processed as in example 5. The speeds for the red, green, and blue records of the film were calculated at a value of 0.15 density above minimum density. In addition, a second set of film strips was subjected to stain processing as in example 2. The optical density of each strip was measured at 560 nm, the wavelength where retained monomeric red sensitizing dye adds density. The 560 nm density, the red speed of the multilayer coatings, and the green minimum density are recorded in Table VII where the red speed for sample 601 is given a value of 100.

TABLE VII

| Sample | Density at 560 nm | Red Speed | Green minimum density | Comment |
|---|---|---|---|---|
| 601 | 0.470 | 100 | 0.573 | comparison |
| 602 | 0.402 | 107 | 0.510 | invention |

It is clear from this example that the dyes of the invention are efficient spectral sensitizers and also afford lower green minimum density due to less dye being retained in the film after processing.

The invention has been described in detail with particular reference to certain preferred embodiments thereof, but it will be understood that variations and modifications can be effected within the spirit and scope of the invention.

What is claimed is:

1. A photographic element comprising a light sensitive silver halide emulsion layer which contains a sensitizing dye of the formula:

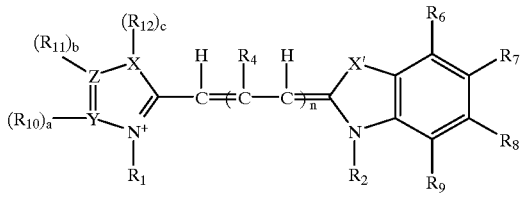

wherein:

n is 0 or 1;

X, Y, and Z are independently O, N, S, Se, or C;

X' is O, $NR_{13}$, S, or Se;

$R_1$ and $R_2$ are acid substituted alkyl;

$R_4$ is H or alkyl, with the proviso that if X' is N, $R_4$ is H;

each of $R_6$, $R_7$, $R_8$ and $R_9$ is independently H or a substituent selected from the group consisting of a substituted or unsubstituted alkyl group, a substituted or unsubstituted aromatic group, a halogen atom, an acylamino group, a carbamoyl group, and a carboxy group, or $R_7$ and $R_8$ or $R_8$ and $R_9$ together with the carbon atoms to which they are attached form a 5-membered or 6-membered ring;

when X or Y or Z is O, N, S or Se then a, b or c, respectively, is 0 and when X or Y or Z is C, a, b or c, respectively is 1 and the corresponding $R_{10}$, $R_{11}$, or $R_{12}$ substituent is independently H or a non-aromatic substituent selected from the group consisting of an alkyl, an alkenyl, a cycloalkyl, a non-aromatic carbocyclic, and a non-aromatic heterocyclic substituent; and $R_{13}$ is alkyl or substituted alkyl.

2. A photographic element according to claim 1, wherein the dye is J-aggregating.

3. A photographic element according to claim 1, wherein Y is N or C, Z is C and X is S.

4. A photographic element according to claim 1, wherein X' is S.

5. A photographic element according to claim 1, wherein $R_1$ and $R_2$ are each sulfoalkyl.

6. A photographic element according to claim 1, wherein R6, R7 and R9 are each H and R8 is halo or phenyl.

7. A photographic element according to claim 1, wherein wherein R6 and R7 are H and R8 and R9 are joined together with the carbon atom to which they are attached to form a benzo ring.

8. A photographic element according to claim 1, wherein the dyes is selected from the group consisting of:

I-1

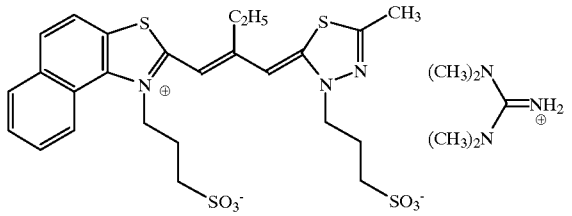

I-2

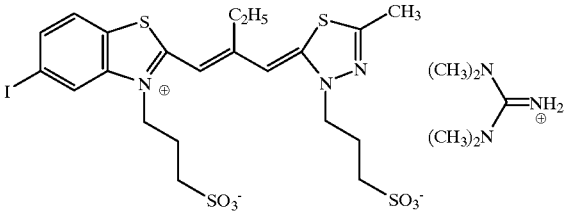

I-3

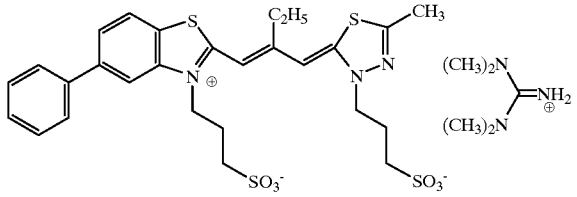

I-4

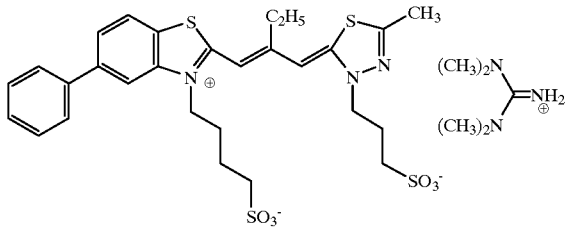

I-5

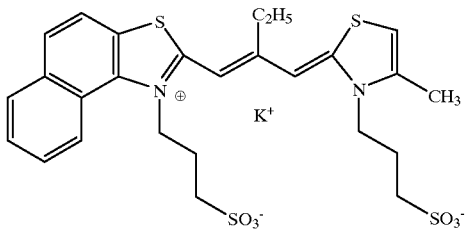

I-6

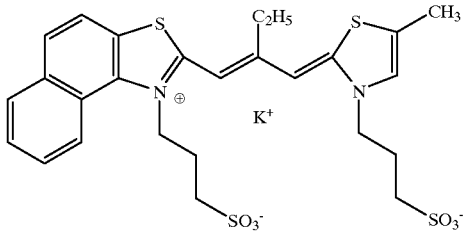

-continued

I-7

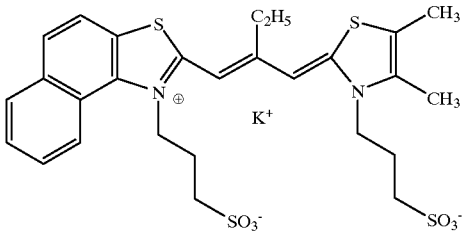

I-8

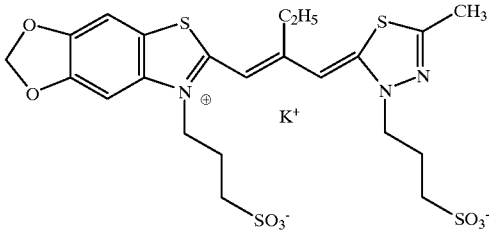

I-10

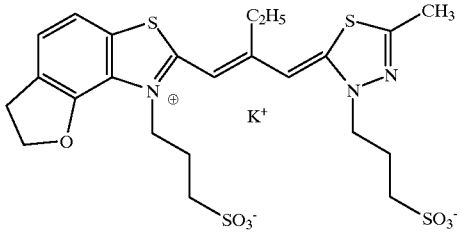

I-11

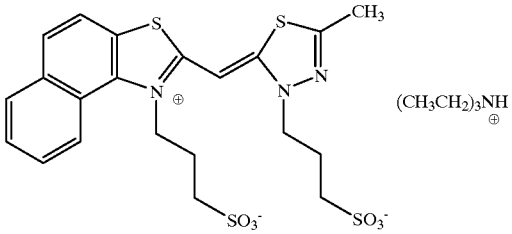

I-12

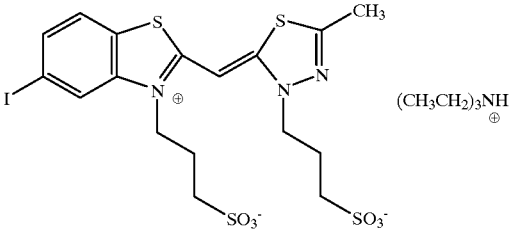

I-13

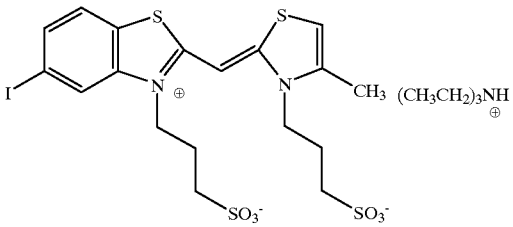

-continued

I-14

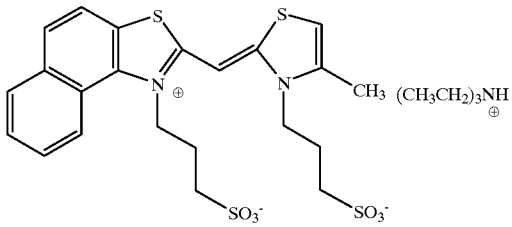

I-15

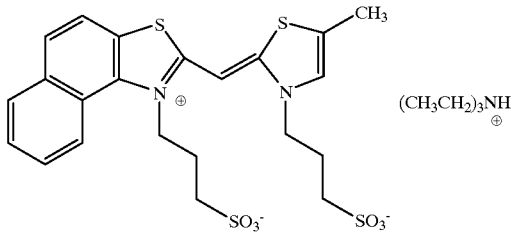

and

I-16

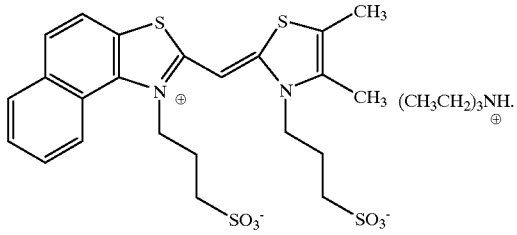

9. A photographic element according to claim 1 wherein each of $R_7$ and $R_8$ is independently H or a substituent selected from the group consisting of a substituted or unsubstituted aromatic group, a halogen atom, an acylamino group, a carbamoyl group, and a carboxy group.

10. A photographic element according to claim 9 wherein $R_8$ is iodine or phenyl.

11. A photographic element according to claim 1 wherein $R_7$ and $R_8$ together with the carbon atoms to which they are attached form a 5-membered or 6-membered ring and $R_9$ is H, or $R_8$ and $R_9$ together with the carbon atoms to which they are attached form a 5-membered or 6-membered ring and $R_7$ is H.

12. A photographic element comprising a light sensitive silver halide emulsion layer which contains a sensitizing dye of the formula:

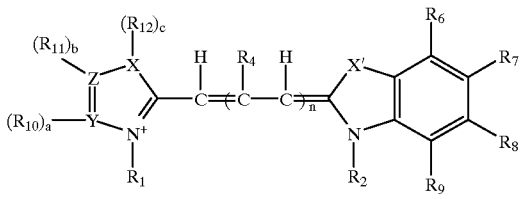

wherein:

n is 0;

X, Y, and Z are independently O, N, S, Se, or C;

X' is O, $NR_{13}$, S, or Se;

$R_1$ and $R_2$ are acid substituted alkyl;

$R_4$ is H or alkyl, with the proviso that if X' is N, $R_4$ is H;

each of $R_6$, $R_7$, $R_8$ and $R_9$ is independently H or a substituent selected from the group consisting of a substituted or unsubstituted alkyl group, a substituted or unsubstituted aromatic group, a halogen atom, an acylamino group, a carbamoyl group, a carboxy group, and an alkoxy group, or $R_7$ and $R_8$ or $R_8$ and $R_9$ together with the carbon atoms to which they are attached form a 5-membered or 6-membered ring;

when X or Y or Z is O, N, S or Se then a, b or c, respectively, is 0 and when X or Y or Z is C, a, b or c, respectively is 1 and the corresponding $R_{10}$, $R_{11}$, or $R_{12}$ substituent is independently H or a non-aromatic substituent selected from the group consisting of an alkyl, an alkenyl, a cycloalkyl, a non-aromatic carbocyclic, and a non-aromatic heterocyclic substituent; and $R_{13}$ is alkyl or substituted alkyl.

13. A photographic element according to claim 12, wherein the dye is J-aggregating.

14. A photographic element according to claim 12, wherein Y is N or C, Z is C and X is S.

15. A photographic element according to claim 12, wherein X' is S.

16. A photographic element according to claim 12, wherein $R_1$ and $R_2$ are each sulfoalkyl.

17. A photographic element comprising a light sensitive silver halide emulsion layer which contains a sensitizing dye of the formula:

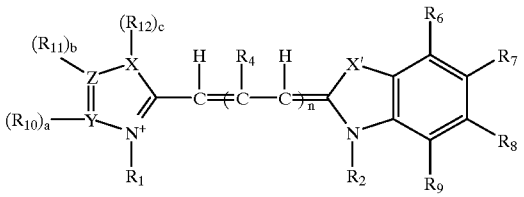

wherein:

n is 0 or 1;

X, Y, and Z are independently O, N, S, Se, or C;

X' is O, $NR_{13}$, S, or Se;

$R_1$ and $R_2$ are acid substituted alkyl;

$R_4$ is H or alkyl, with the proviso that if X' is N, $R_4$ is H;

each of $R_6$ and $R_9$ is independently H or a substituent selected from the group consisting of a substituted or unsubstituted alkyl group, a substituted or unsubstituted aromatic group, a halogen atom, an acylamino group, a carbamoyl group, a carboxy group, and an alkoxy group, and $R_7$ and $R_8$ together with the carbon atoms to which they are attached form a 5-membered or 6-membered ring;

when X or Y or Z is O, N, S or Se then a, b or c, respectively, is 0 and when X or Y or Z is C, a, b or c, respectively is 1 and the corresponding $R_{10}$, $R_{11}$, or $R_{12}$ substituent is independently H or a non-aromatic substituent selected from the group consisting of an alkyl, an alkenyl, a cycloalkyl, a non-aromatic carbocyclic, and a non-aromatic heterocyclic substituent; and $R_{13}$ is alkyl or substituted alkyl.

18. A photographic element according to claim 17, wherein the dye is J-aggregating.

19. A photographic element according to claim 17, wherein Y is N or C, Z is C and X is S.

20. A photographic element according to claim 17, wherein X' is S.

21. A photographic element according to claim 17, wherein $R_1$ and $R_2$ are each sulfoalkyl.

22. A photographic element comprising a light sensitive silver halide emulsion layer which contains a sensitizing dye of the formula:

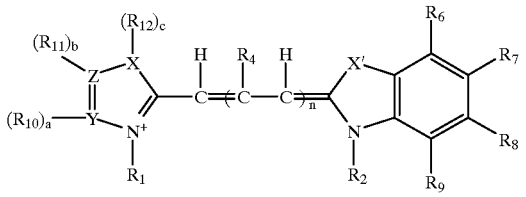

wherein:

n is 0 or 1;

X, Y, and Z are independently O, N, S, Se, or C;

X' is O, $NR_{13}$, S, or Se;

$R_1$ and $R_2$ are acid substituted alkyl;

$R_4$ is H or alkyl, with the proviso that if X' is N, $R_4$ is H;

each of $R_6$ and $R_7$ is independently H or a substituent selected from the group consisting of a substituted or unsubstituted alkyl group, a substituted or unsubstituted aromatic group, a halogen atom, an acylamino group, a carbamoyl group, a carboxy group, and an alkoxy group, and $R_8$ and $R_9$ together with the carbon atoms to which they are attached form a 5-membered or 6-membered ring;

when X or Y or Z is O, N, S or Se then a, b or c, respectively, is 0 and when X or Y or Z is C, a, b or c, respectively is 1 and the corresponding $R_{10}$, $R_{11}$, or $R_{12}$ substituent is independently H or a non-aromatic substituent selected from the group consisting of an alkyl, an alkenyl, a cycloalkyl, a non-aromatic carbocyclic, and a non-aromatic heterocyclic substituent; and $R_{13}$ is alkyl or substituted alkyl.

23. A photographic element according to claim 22, wherein the dye is J-aggregating.

24. A photographic element according to claim 22, wherein Y is N or C, Z is C and X is S.

25. A photographic element according to claim 22, wherein X' is S.

26. A photographic element according to claim 22, wherein $R_1$ and $R_2$ are each sulfoalkyl.

* * * * *